US010040307B2

(12) United States Patent
Dove et al.

(10) Patent No.: US 10,040,307 B2
(45) Date of Patent: Aug. 7, 2018

(54) HINGED GREETING CARDS AND GIFT CARD HOLDERS

(71) Applicant: American Greetings Corporation, Cleveland, OH (US)

(72) Inventors: Jason Dove, Parma, OH (US); Sean Higgins, Lakewood, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 15/713,830

(22) Filed: Sep. 25, 2017

(65) Prior Publication Data

US 2018/0009253 A1 Jan. 11, 2018

Related U.S. Application Data

(62) Division of application No. 15/592,518, filed on May 11, 2017, now Pat. No. 9,849,712.

(60) Provisional application No. 62/339,888, filed on May 22, 2016.

(51) Int. Cl.

| | |
|---|---|
| ***G09F 1/04*** | (2006.01) |
| ***B42D 15/02*** | (2006.01) |
| ***G09F 1/10*** | (2006.01) |
| ***B42D 15/04*** | (2006.01) |

(52) U.S. Cl.

CPC ..... *B42D 15/022* (2013.01); *B42D 15/045* (2013.01); *G09F 1/10* (2013.01)

(58) Field of Classification Search

CPC ..... B42D 15/022; B42D 15/02; B42D 15/04; B42D 15/042; B42D 15/045; G09F 1/04; G09F 1/06; G09F 1/08

USPC ..... 40/124.01, 124.03, 423

See application file for complete search history.

(56) References Cited

U.S. PATENT DOCUMENTS

| | | | | |
|---|---|---|---|---|
| 8,739,438 | B1 * | 6/2014 | Deckerd | B42D 15/022 40/124.02 |
| 2011/0078931 | A1 * | 4/2011 | Sapp | B42D 15/022 40/124.03 |
| 2013/0086831 | A1 * | 4/2013 | Mayer | G09F 1/08 40/124.03 |
| 2013/0097899 | A1 * | 4/2013 | Budzar | G09F 1/06 40/124.03 |
| 2014/0360064 | A1 * | 12/2014 | Mayer | B42D 15/022 40/124.03 |
| 2016/0159135 | A1 * | 6/2016 | Talbot | B42D 15/022 40/124.03 |

FOREIGN PATENT DOCUMENTS

| | | | |
|---|---|---|---|
| JP | 3205843 U | * | 8/2016 |

* cited by examiner

*Primary Examiner* — Cassandra H Davis
(74) *Attorney, Agent, or Firm* — Christine Flanagan

(57) ABSTRACT

Interactive greeting card and gift card holders with a hinged mechanism which provide fun user interaction and triggers audio playback. Each greeting card and gift card holder includes portion thereof which hinges or pivots about an axis. When the greeting card or gift card holder is hinged, or pivoted about the hinge, one or more special effects are triggered. Special effects may include audio, emergence or ejection of a gift card holder (w/gift card) or gift card, the appearance of a thought or word bubble, or any other special effect.

9 Claims, 11 Drawing Sheets

HINGED GREETING CARDS AND GIFT CARD HOLDERS

RELATED APPLICATIONS

This application is a divisional of and claims priority to U.S. patent application Ser. No. 15/592,518, filed on May 11, 2017, which claims priority to U.S. Provisional Patent Application No. 62/339,888, filed on May 22, 2016. A copy of the above-referenced documents is incorporated herein by reference in their entirety.

FIELD OF THE INVENTION

The present invention is in the field of social expression products and more specifically this invention is directed to greeting cards and gift card holders having a hinged activation mechanism for triggering audio playback and other special effects.

SUMMARY OF THE INVENTION

Interactive gift card holders and greeting cards with a hinged mechanism which provide fun user interaction and triggers audio playback.

In one embodiment, a gift card holder includes a carrier having a first portion and a second portion which are attached at a pivot point, a sleeve which is operative to move between a first position concealed within the carrier and a second position substantially outside of the carrier, and a gift card holder which is operative to move between a first position concealed within the sleeve and a second position substantially outside of the sleeve. Moving the first and second portions of the carrier away from each other about the pivot point moves the sleeve and the gift card holder from the first position to the second position.

In another embodiment, a greeting card includes a greeting card body comprising an upper portion and a lower portion, the upper and lower portions being connected at a pivot point and a sound module which is contained within the greeting card body and is operative to store and playback at least one audio clip. Partially pivoting the upper portion of the greeting card body away from or towards the lower portion of the greeting card body triggers the sound module to play the at least one audio clip.

DETAILED DESCRIPTION OF PREFERRED AND ALTERNATE EMBODIMENTS

The various embodiments of the present invention include a greeting card or gift card holder having a portion thereof which hinges or pivots about an axis. When the greeting card or gift card holder is hinged, or pivoted about the hinge, one or more special effects are triggered. Special effects may include audio, emergence or ejection of a gift card holder (w/gift card) or gift card, the appearance of a thought or word bubble, or any other special effect.

Figure 1:
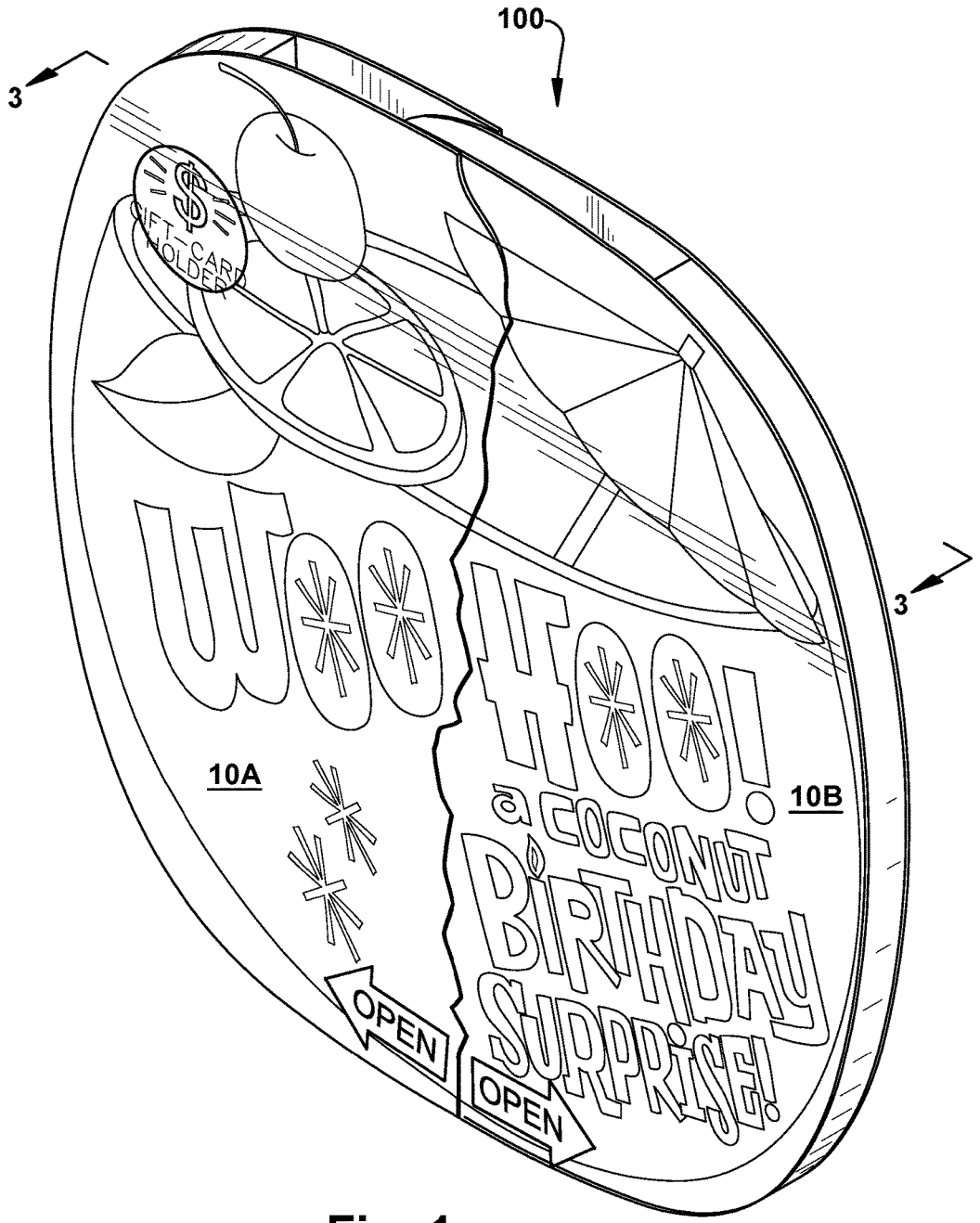
FIG. 1 is a perspective view of a first embodiment of the HINGED GREETING CARD AND GIFT CARD HOLDERS of the present invention, in a closed position.
Figure 2:
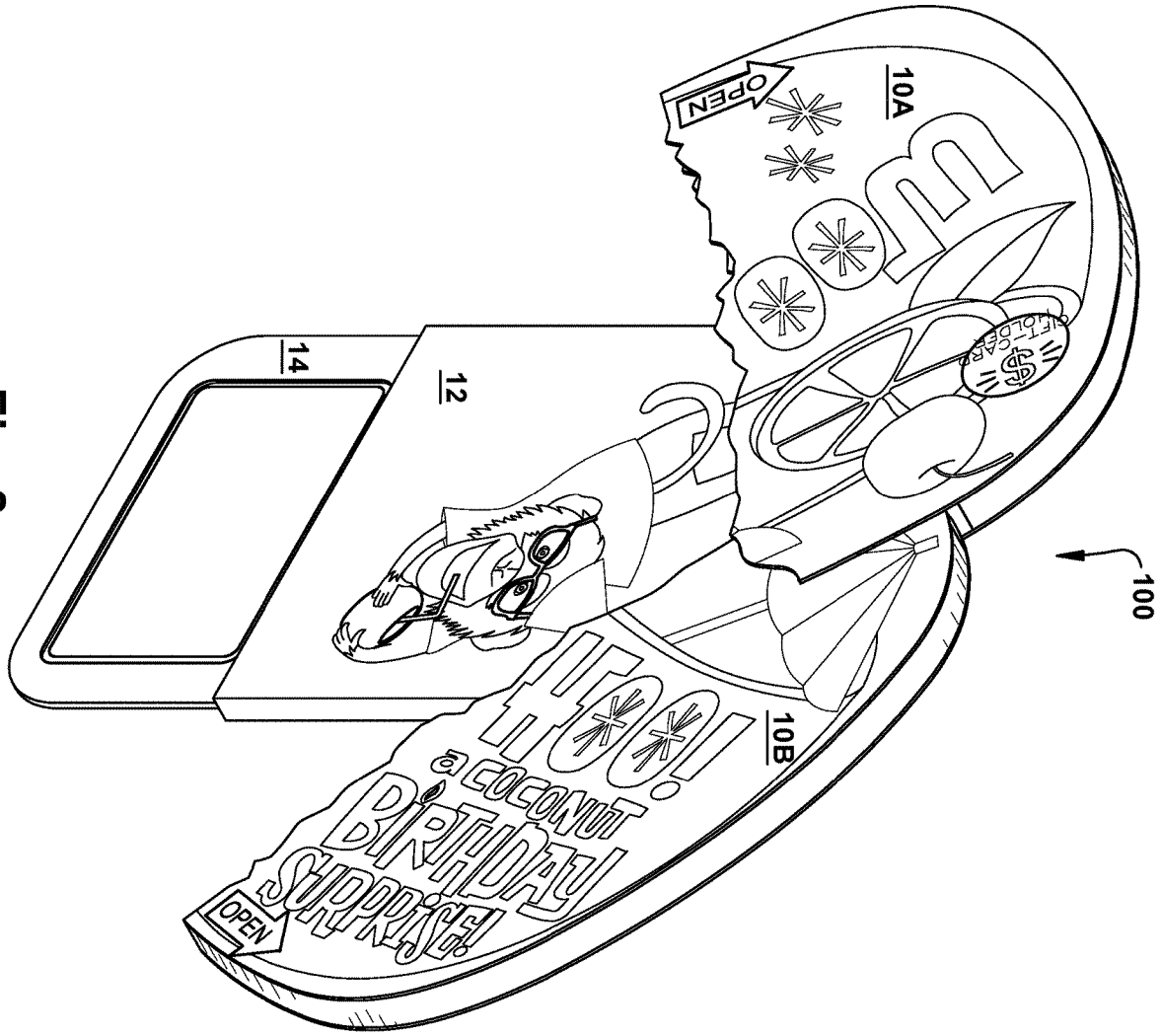
FIG. 2 is a perspective view of the HINGED GREETING CARD AND GIFT CARD HOLDER of FIG. 1, in an open position.
Figure 3:
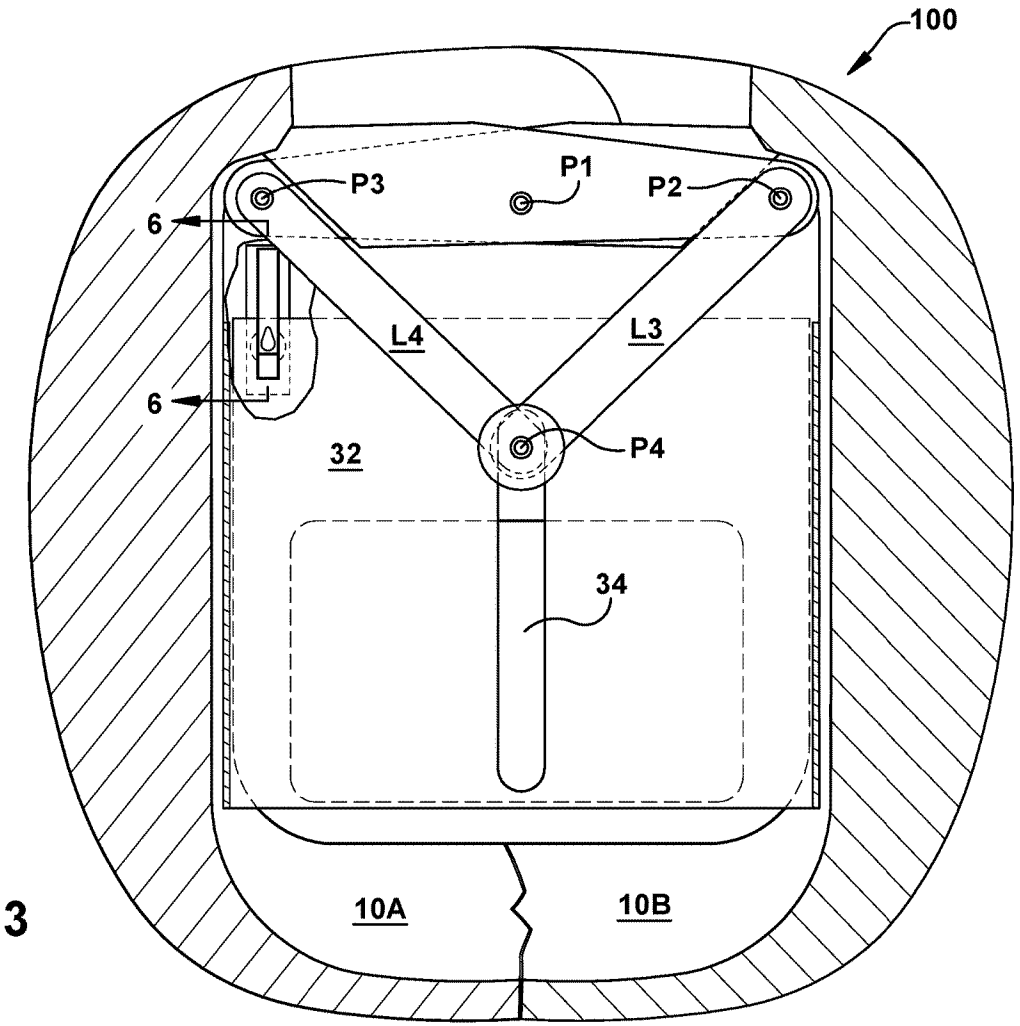
FIG. 3 is a front view of the internal mechanics of the HINGED GREETING CARD AND GIFT CARD HOLDER of FIG. 1, in a first position.
Figure 4:
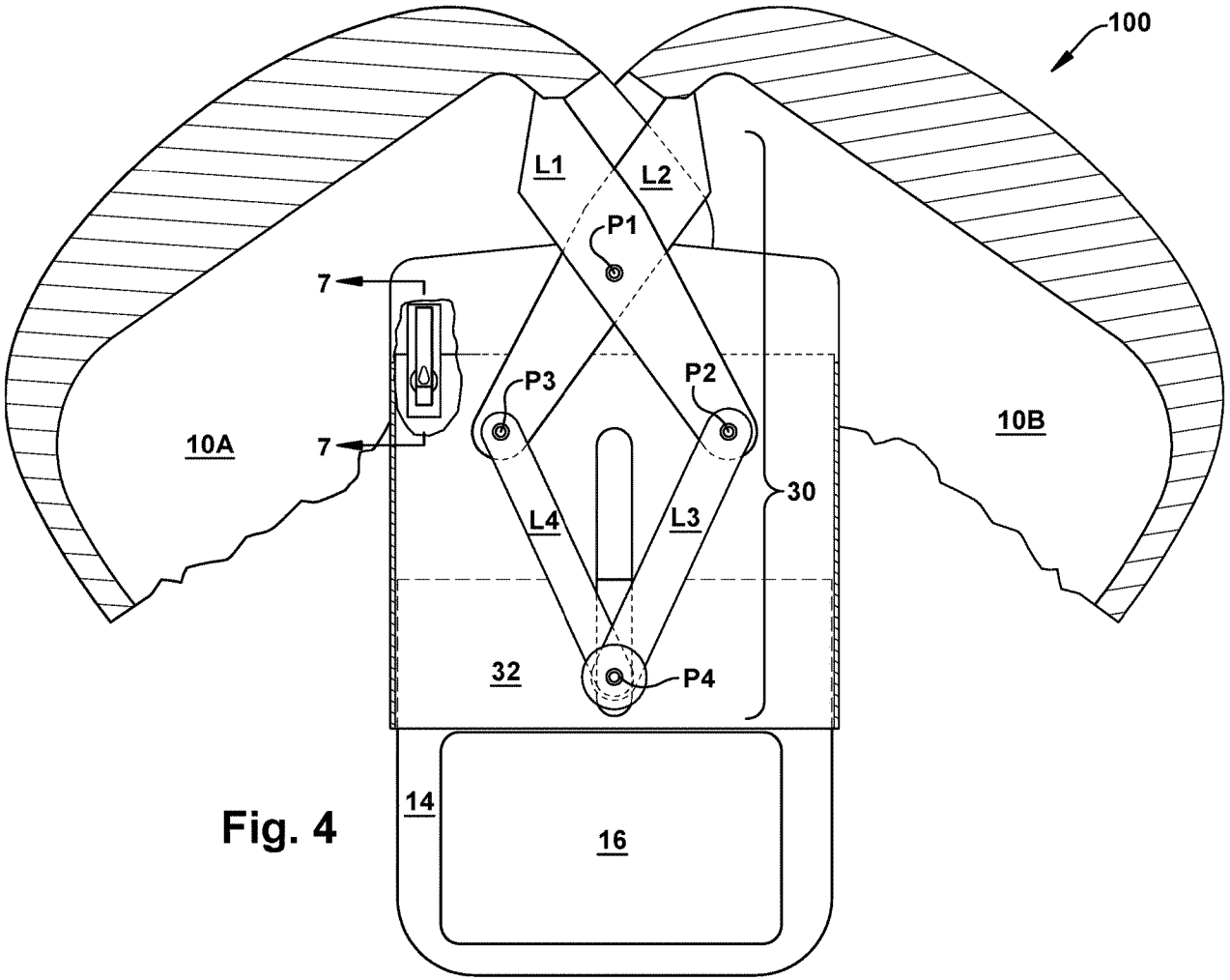
FIG. 4 is a front view of the internal mechanics of the HINGED GREETING CARD AND GIFT CARD HOLDER of FIG. 1, in second position.
Figure 7:
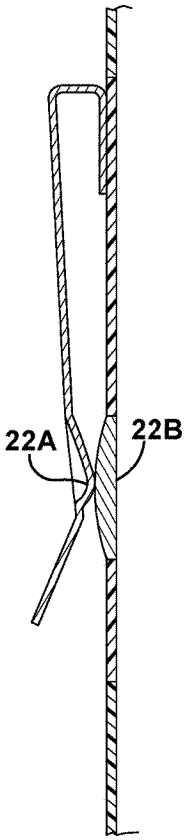
FIG. 7 is a cross-sectional view of the HINGED GREETING CARD AND GIFT CARD HOLDER of FIG. 4, from the perspective of arrows 7-7.
Figure 6:
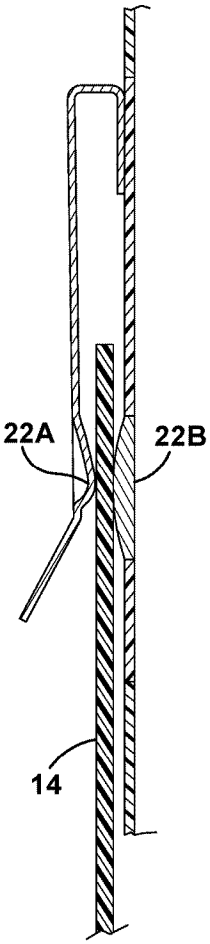
FIG. 6 is a cross-sectional view of the HINGED GREETING CARD AND GIFT CARD HOLDER of FIG. 3, from the perspective of arrows 6-6.
Figure 5:
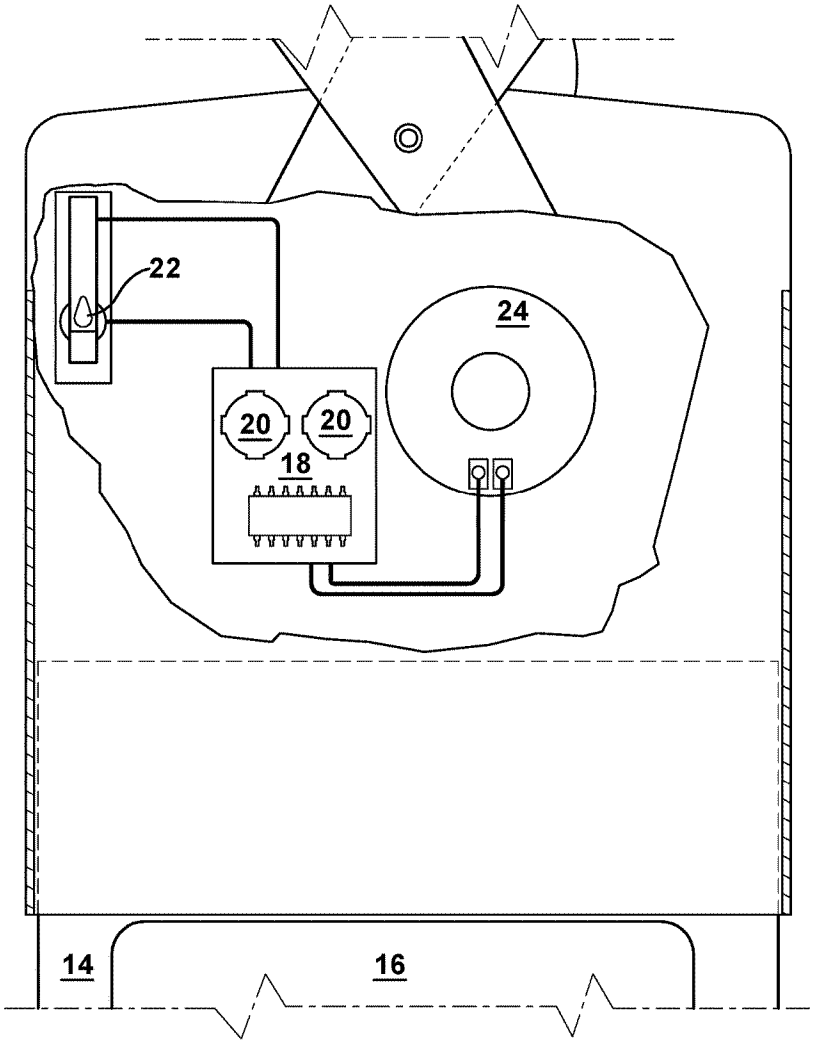
FIG. 5 is a front view of the electronic components of the HINGED GREETING CARD AND GIFT CARD HOLDER of FIG. 1.
Figure 9:
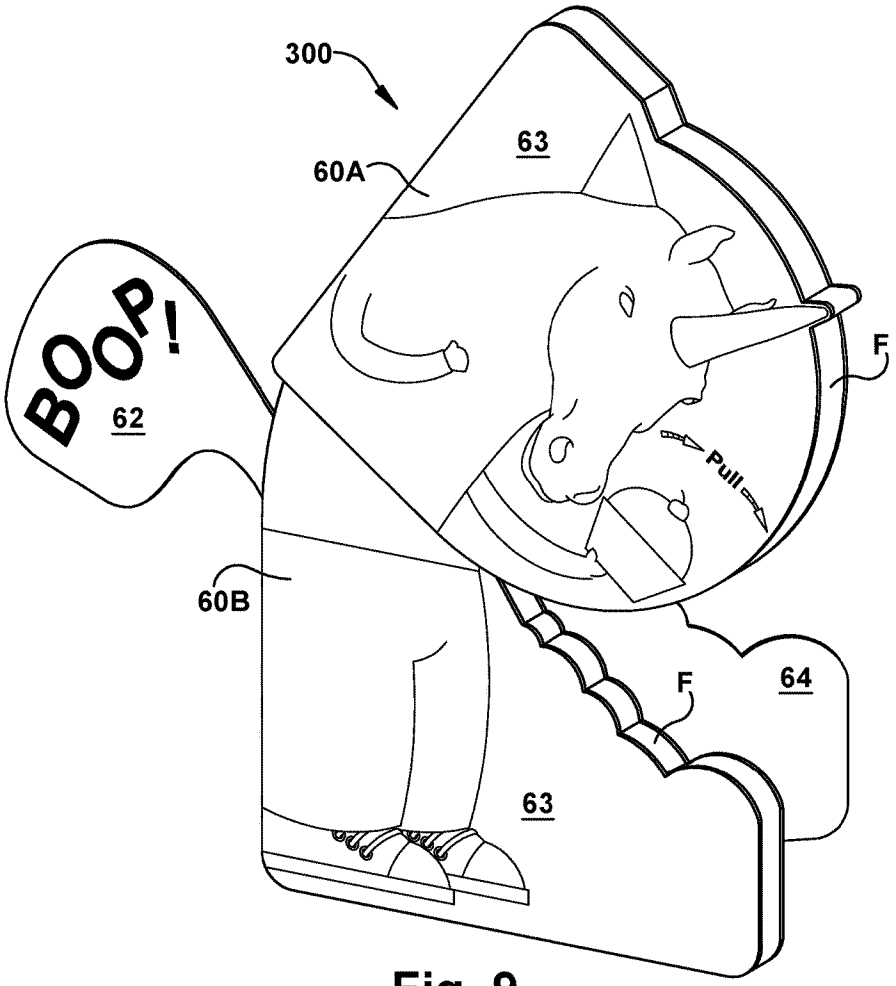
FIG. 9 is a perspective view of the HINGED GREETING CARD AND GIFT CARD HOLDER of FIG. 8, in a second position.
Figure 8:
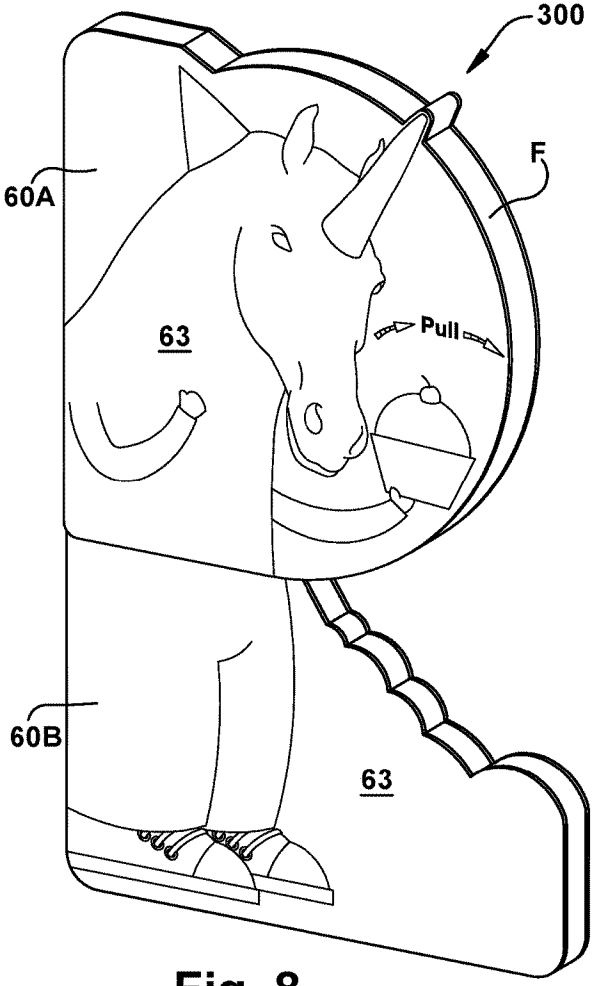
FIG. 8 is a perspective view of a second embodiment of the HINGED GREETING CARD AND GIFT CARD HOLDER of the present invention, in a first position.
Figure 10:
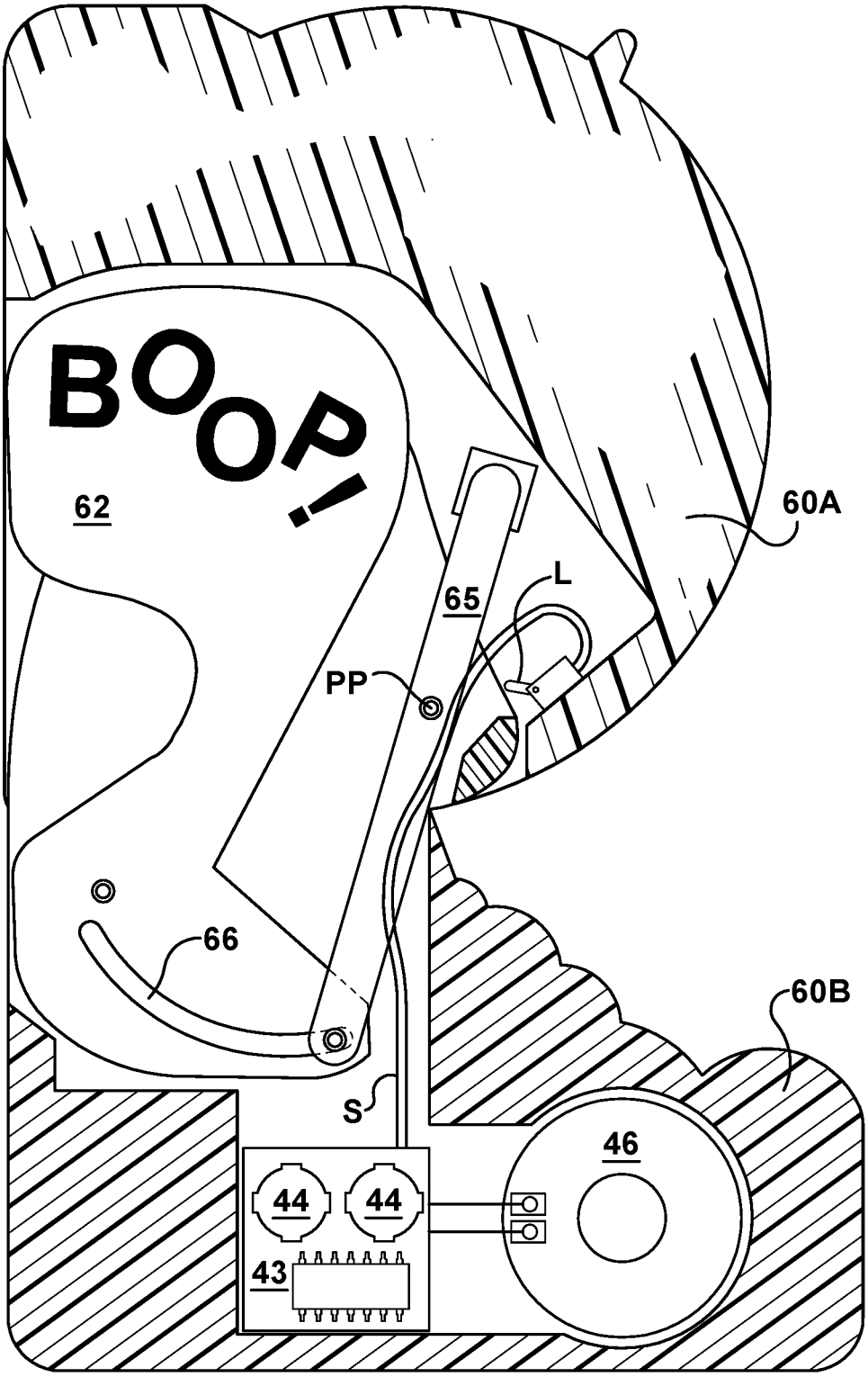
FIG. 10 is a front view of the internal mechanical and electronic components of the HINGED GREETING CARD AND GIFT CARD HOLDER of FIG. 8.
Figure 11:
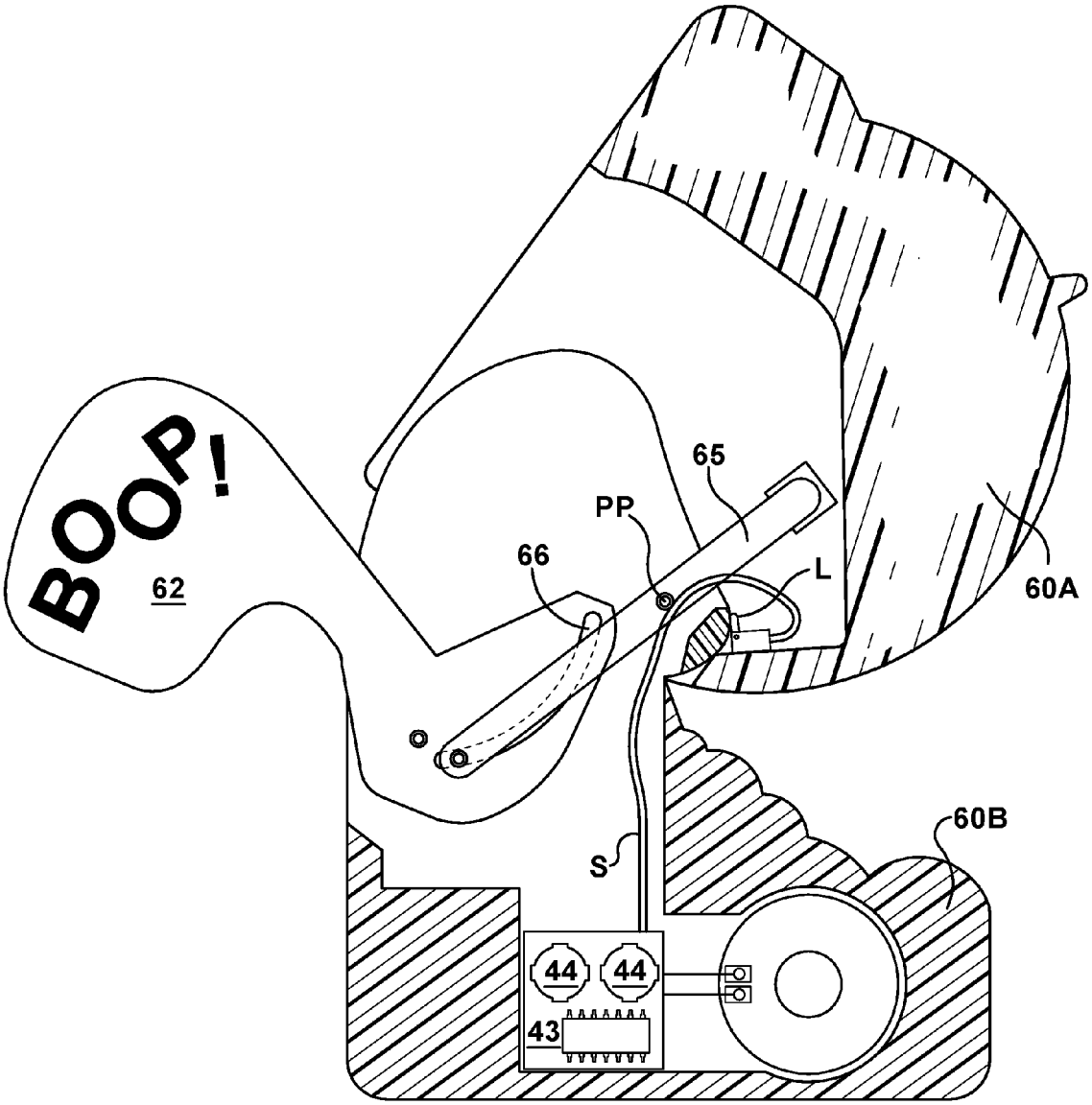
FIG. 11 is a front view of the internal mechanical and electronic components of the HINGED GREETING CARD AND GIFT CARD HOLDER of FIG. 9.
Figure 13:
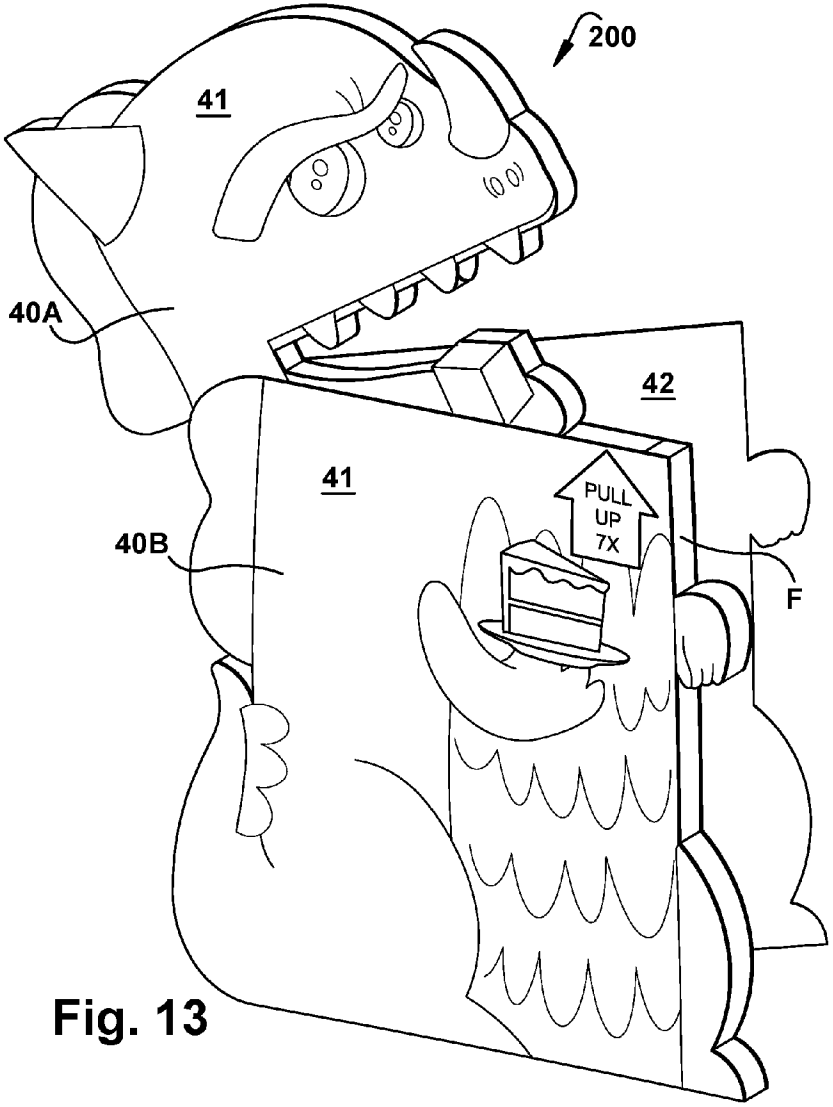
FIG. 13 is a perspective view of the HINGED GREETING CARD AND GIFT CARD HOLDER of FIG. 12, in a second position.
Figure 12:
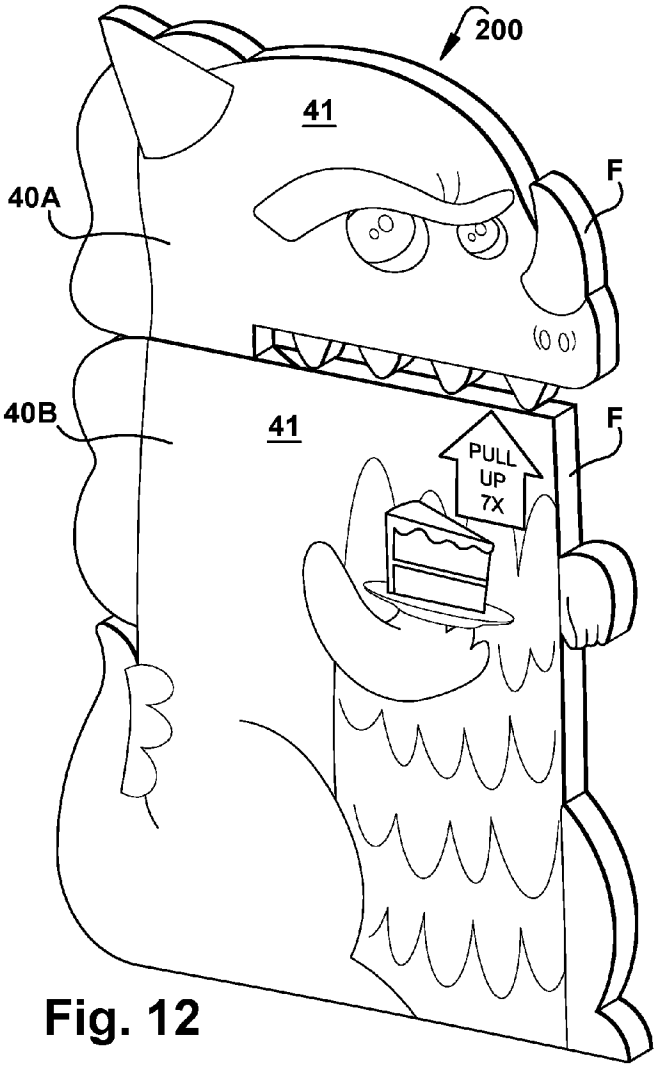
FIG. 12 is a perspective view of a third embodiment of the HINGED GREETING CARD AND GIFT CARD HOLDER of the present invention, in a first position.
Figure 14:
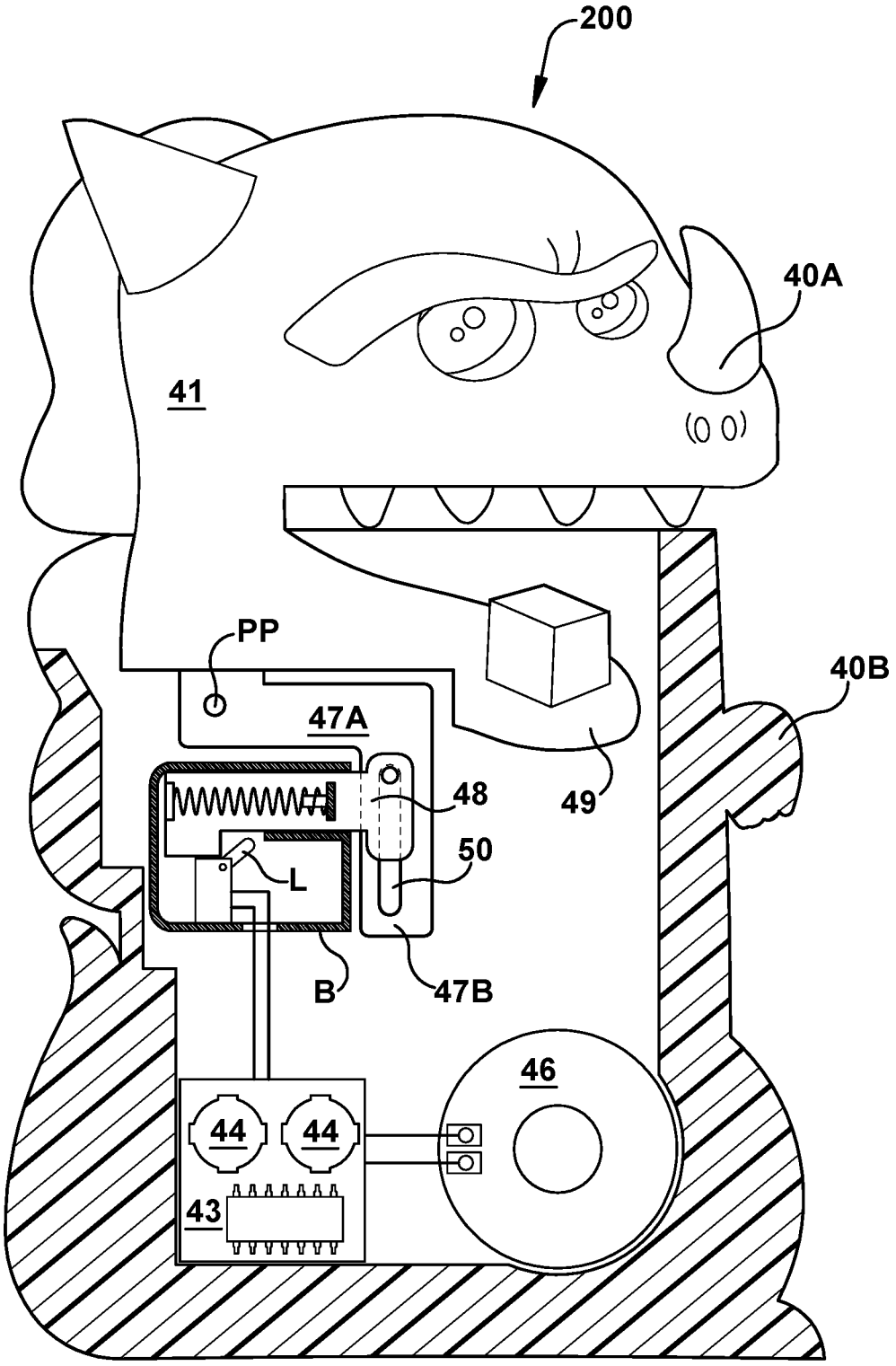
FIG. 14 is a front view of the mechanical and electronic components of the HINGED GREETING CARD AND GIFT CARD HOLDER of FIG. 12.
Figure 15:
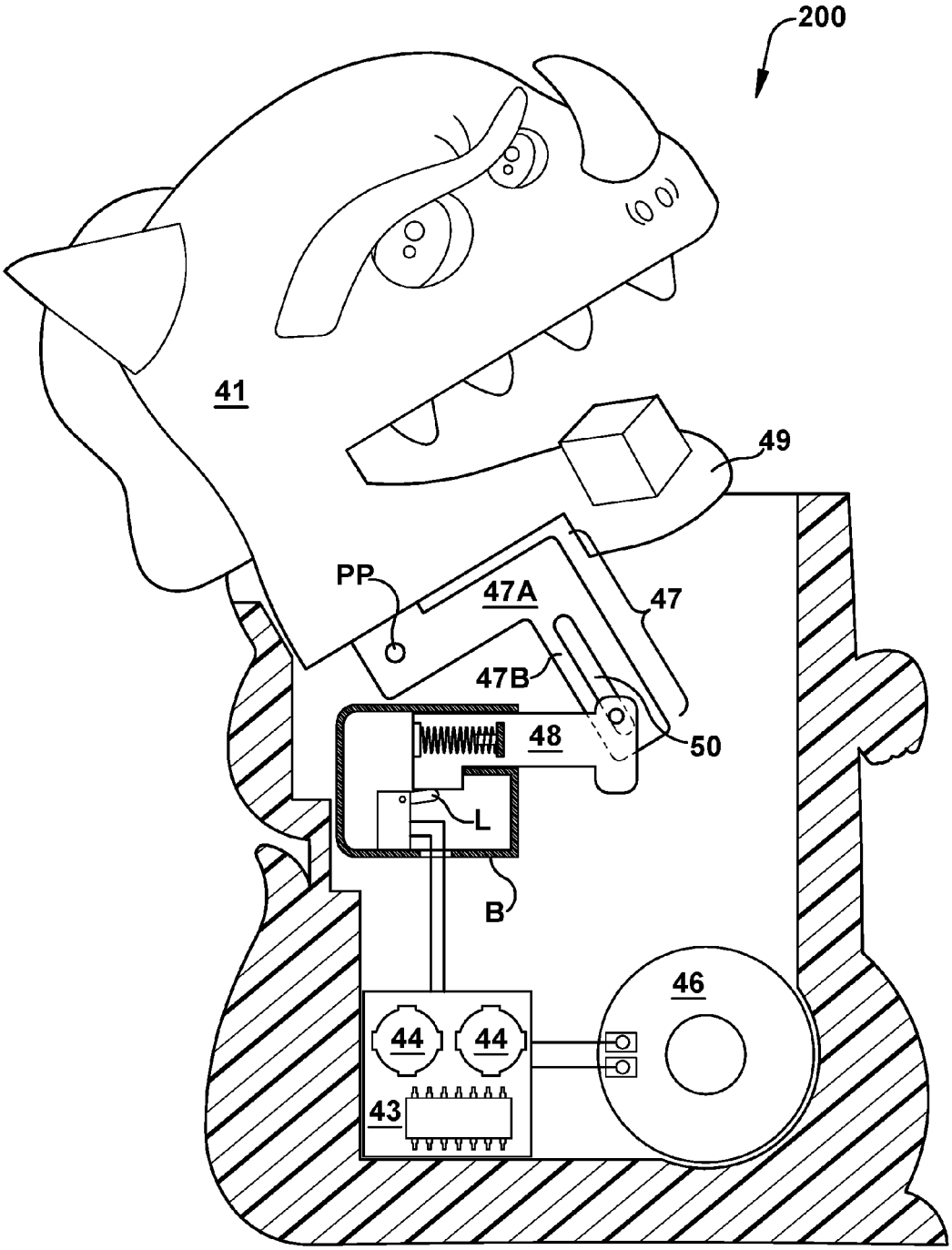
FIG. 15 is a front view of the mechanical and electronic components of the HINGED GREETING CARD AND GIFT CARD HOLDER of FIG. 13.

In a first embodiment of the present disclosure and related inventions, shown in FIGS. 1 through 5, a gift card holder 100 includes a gift card holder body 10, a sleeve 12, a sliding panel (with gift card receptacle) 14 and optional gift card 16. The gift card holder body 10 includes two separate and distinct portions, a left 10A and right 10B side portion, which are connected using a hinged mechanism 30 such that the two portions 10A, 10B can pivot or hinge with respect to one another about a pivot point P1. A sleeve 12 is contained between the two portions 10A, 10B of the gift card holder body 10 when the gift card holder body 10 is in a closed position (shown in FIG. 1) and it is revealed upon opening the gift card holder 100 by hinging or pivoting the two portions 10A, 10B of the gift card holder body 10 away from each other (shown in FIG. 2). Each of the two portions 10A, 10B of the gift card holder body 10 are generally mirror images of one another and in one embodiment, are intended to represent some type of nut, such as an acorn. Each portion 10A, 10B of the gif card holder body 10 may be made partially of foam or other lightweight material, such as cardboard or paperboard. The gift card holder 100 may contain a sheet material on the front and/or rear surface of the gift card holder body 10 and said sheet material may contain photos, drawings, pictures, text or any type of printing thereon as well as additional embellishments such as faux fur, feathers, googly eyes, gems, etc. The gift card holder body 10 may have one or more cavities therein for the concealment and storage of the sleeve 12, sliding panel (and gift card receptacle) 14, optional gift card 16 and other internal components of the gift card holder 100 or the gift card holder body 10 may be more like a frame which surrounds said internal components. The sleeve 12 is contained between and inside the two portions 10A, 10B of the gift card holder body 10. The sleeve 12 includes a sliding panel with receptacle or recessed portion therein for insertion and removal of a gift card (also referred to as the gift card receptacle) 14. The sleeve 12 can move from a first position wherein it is contained and concealed within the gift card holder body 10, as shown in FIG. 1, and a second position wherein it is substantially outside of the gift card holder body 10, as shown in FIG. 2. The sliding panel (with gift card receptacle) 14 can also move from a first position, wherein it is contained within the sleeve 12 and a second position wherein it is substantially outside of the sleeve 12. A sound module may also be contained and concealed within the one or more cavities contained within the gift card holder body 10. The components of the sound module may be placed in either side 10A, 10B of the gift card holder body 10A or may be split across both sides 10A, 10B of the gift card holder body 10. The sound module may include, but is not limited to: an electronic circuit with chip and controller 18, one or more batteries 20 to power the circuit, a switch 22 which controls activation of the circuit, a memory device having one or more sound files contained thereon and a speaker 24, as shown in FIG. 5. The sound module may include any component which is required or which facilitates storage and playback of at least one audio file. The at least one audio file may contain a song, music, spoken word, or any other recordable sound. The hinge mechanism 30 is located in an upper portion of the gift card holder body 10 between the left 10A and right 10B side portions. The hinge mechanism 30, in one embodiment, includes a plurality of interconnected levers L1, L2, L3, L4 attached at a plurality of pivot points P1, P2, P3, P4. As shown in FIG. 4, the left 10A and right 10B sides of the gift card holder body 10 are each attached to a lever L1, L2, the two levers L1 and L2 being connected at a first pivot point P1. The two levers L1, L2 are also attached to a third L3 and fourth L4 lever about a second P2 and third P3 pivot point. The third L3 and fourth L4 levers are connected to each other at a fourth P4 pivot point. The sleeve 12 is moveable between the first position (inside the gift card holder body 10—FIG. 1) and the second position (outside the gift card holder body 10—FIG. 2) by movement of the L1 and L2 levers when the two sides 10A, 10B of the gift card holder body 10 are separated from one another about the first pivot point P1. The sliding panel 14 is moveable between the first position (inside the sleeve 12—FIGS. 1, 3) and the second position (outside the sleeve 12—FIGS. 2, 4) via slidable attachment to an inner panel 32 (at pivot point P4). The inner panel 32 contains vertical rectangular cutout 34 contained thereon through which pivot point P4 and inner panel 32 are slidable. As shown in FIG. 3, levers L1 and L2 are overlapping each other with levers L3 and L4 each extending downward therefrom at an inward angle with pivot point P4 contained at the upper end of the vertical rectangular cutout 34. In this position, the sleeve 12 and sliding panel 14 are contained within the gift card holder body 10. As shown in FIG. 4, the two sides 10A, 10B of the gift card holder body 10 are opened or pulled apart (moved from the first position to the second position), pulling levers L1, L2, L3 and L4 downward so that pivot point P4 is moved to the lower end of the vertical rectangular cutout 34, thereby causing the sleeve 12 to emerge from within the gift card holder body 10 and also causing the sliding panel 14 to emerge from the sleeve 12, thereby revealing an optional gift card 16 contained within the sliding panel 14. Moving the left 10A and right 10B side portions of the gift card holder body 10 away from one another (from the first position to the second position) about the hinge or pivot point P1 also triggers replay of the one or more audio files contained on the sound module. A switch 22 is located within the sleeve 12 and removably attached to a portion of the sliding panel 14. In one embodiment, as shown in the figures, the switch is a contact switch. As shown in FIG. 6, when the gift card holder 100 is in the first position, wherein the sleeve 12 and the sliding panel 14 are contained within the gift card holder body 10, a portion of the sliding panel 14 is inserted between two contacts 22A, 22B of the contact switch 22, thereby preventing completion of an electrical circuit which provides power to the sound module. As shown in FIG. 7, when the gift card holder 100 is opened or moved to the second position by separating the left 10A and right 10B sides of the gift card holder body 10, the portion of the sliding panel 14 which was inserted between the two contacts 22A, 22B of the switch 22, is removed, thereby allowing completion of the electrical circuit and providing power to the sound module. Moving the left 10A and right 10B side portions of the gift card holder body 10 back together (from the second position back to the first position) causes the sliding panel 14 to recede into the sleeve 12 and also causing the sleeve 12 to recede into the gift card holder body 10. It also causes the audio playback to cease (if it has not already played for its predetermined amount of time). In one embodiment, as shown in the figures, the gift card holder body 10 is intended to resemble a nut, such as an acorn and moving the two portions 10A, 10B away from one another about the hinge or pivot point P1 is intended to simulate cracking open a nut to reveal what is inside.

In a second embodiment of the present disclosure and related inventions, as shown in FIGS. 12 through 15, a greeting card 200 includes a greeting card body 40 having one or more cavities or openings contained therein, the greeting card body 40 having at least two distinct or separate portions 40A, 40B, one of the at least two distinct or separate portions 40A being capable of hinging or pivoting about a hinge or pivot point with respect to the other portion 40B. The greeting card body 40, in one embodiment, is partially made of foam F having a planar sheet material 41 attached to the front and rear surfaces thereof. While foam F is mentioned as a possible material, other materials such as plastic, paper, paperboard, cardboard, etc., have been contemplated and may be used in combination with or in place of foam and use of other non-foam materials are considered to be within the scope of this invention. The planar sheet material 41, in one embodiment, is paperboard, however it may be paper, cardboard, plastic, or any other such material. The planar sheet material 41 may contain printing thereon including but not limited to: text sentiment, photos, pictures, drawings, or any other printable material. The planar sheet material 41 may contain additional embellishments including, but not limited to: glitter, googly eyes, gems, faux fur, or any other such adornment. In one embodiment, the greeting card body 40 and planar sheet material 41 are shaped and decorated to depict an animal or character. Examples include, but are not limited to: a dog, a unicorn, a dinosaur and a shark. A sentiment panel 42, which is an additional planar sheet may be attached to the planar sheet material 41 attached to the rear surface of the greeting card body 40 (preferably to the second or larger piece 40B representing the animal or character body). The sentiment panel 42 folds away from the rear planar sheet material 41 to mimic a traditional greeting card. The inside or front surface of the sentiment panel 42 may contain text sentiment and other printing thereon and may include space for the sender to include written sentiment and a signature. As mentioned above, the greeting card body 40 includes two separate and distinct foam pieces 40A, 40B, a first foam piece 40A (also referred to herein as the "upper" portion or the "head") which serves as the head of an animal or character, and a second foam piece 40B (also referred to herein as the "lower" portion or the "body") which serves as the body of the animal or character. Generally, the second piece 40B or body is larger in size that the first piece 40A or head, although in other embodiments, this may be reversed. The planar sheet material 41 is preferably die cut into the shape of the first (head) 40A and second (body) 40B foam pieces with printing thereon to further represent the head and body of an animal or character. The first foam piece or head 40A of the animal or character may be a solid foam piece F which is covered on a front surface with a planar sheet material 41 which is the front or side view of the head and face of an animal or character. The second foam piece or body 40B of the animal or character may be a foam piece F having one or more cavities therein for the storage of the internal components of the greeting card 200 or may be a frame-like structure surrounding said internal components. The internal components of the greeting card may include, but are not limited to: a sound module comprising an electronic circuit with chip and controller 43, one or more batteries 44 to power the circuit, a switch which controls activation of the circuit, a memory device having at least one sound filed contained thereon and a speaker 46. The chip, in a preferred embodiment, is an integrated circuit chip comprising memory with at least one sound file contained thereon; some logic to convert the digital sound file to a signal that can vibrate the speaker 46 and some timing logic to step through all of the data on the sound file. The memory part of the circuit holds the sound data in a format such as .mp3, .wav, or any other such format. In one embodiment, as shown in the figures, the switch is a pull or slide switch. The upper portion or head 40A of the greeting card 200 is attached to the lower portion or body 40B of the greeting card 200 via a hinge element 47 which allows the head portion 40A to be hinged or pivoted about a hinge or pivot point PP with respect to the body portion 40B. This enables the first or head portion 40A to be partially moved away from the body portion 40B of the greeting card 200. In one embodiment, the hinge mechanism 47 and pivot point PP are located near an upper left corner of the body portion 40B of the greeting card 200. A lower left corner of the upper foam portion 40A of the greeting card 200 is attached to the hinge mechanism so that it can partially pivot away from the lower foam portion 40B of the greeting card 200 when the right side of the upper foam portion 40A is lifted upward or away from the lower foam portion 40B. The hinge element 47 contains two legs or segments which are contiguous with and perpendicular to one another. A first segment 47A is horizontally positioned and a second segment 47B is vertically oriented. The first or horizontal segment 47A contains the pivot point PP thereon which attaches the head 40A and body 40B portion of the greeting card 200. The second or vertical segment 47B contains a vertical cutout or slot 50 contained thereon. The vertical cutout or slot 50 accommodates activation of the switch when the head portion 40A of the greeting card 200 is moved or tilted away from the body portion 40B of the greeting card. The switch mechanism includes a lever L, a spring-loaded slide element 48. The slide element 48 is contained within a box B and attached to or inserted into the slot 50 on the second or vertical segment 47B of the hinge element 47. When the head portion 40A of the greeting card 200 is moved or tilted away from the body portion 40B of the greeting card 200, the slide element 48 of the switch moves from a first position (shown in FIG. 14), inside the box B and at the top or uppermost edge of the slot 50, to a second position (shown in FIG. 15), which is substantially outside of the box B and at the end or lowermost edge of the slot 50. When the slide element 48 of the switch reaches the end of the slot 50 it depresses a lever portion L of the switch 48 which completes the electrical circuit thereby triggering the sound module to replay the audio file through the speaker 46. When the head portion 40A of the greeting card 200 is released, it snaps back to its original position atop the body portion 40B of the greeting card 200, which also causes the spring-loaded slide element 48 to return to its original position and releasing the lever L portion of the switch thereby interrupting the circuit and ceasing playback of the audio file. The at least one sound file may contain spoken word, music, songs or a portion thereof, movie clips, or any other recordable sounds. In one embodiment, the audio file contains 26 seconds of audio broken into seven different clips. The audio clips may interrupt each other if the head 40A is tilted again before reaching completion of the previous clip. In operation, the greeting card recipient may open the greeting card 200 by moving the sentiment panel 42 away from the greeting card body 40 to view the text sentiment or other printing thereon and to view the optional personalized message and signature written by the greeting card sender. The front face of the greeting card 200 may contain printing or a sticker thereon which instructs the greeting card recipient to "pull up" or "lift here" on the top portion 40A of the greeting card 200. Lifting or pulling upward on the head portion 40A of the greeting card 200 causes it to pivot or hinge about the pivot point PP which removes the spring-loaded slide element 48 of the switch from the box B thereby moving the lever L from its original position thereby allowing the circuit to be completed and triggering playback of the at least one audio file from the sound module. The user may continuously lift or tilt the head portion 40A of the greeting card 200 to hear additional audio clips and if one audio clip is not played to completion before the head portion 40A of the greeting card 200 is lifted or tilted again, the next audio clip will interrupt the clip that was being played. Once a user lifts the head or top portion 40A of the greeting card 200 and releases it, it snaps back to its original position. To initiate another audio clip, the user must again lift the head portion 40A of the greeting card 200. Lifting or pulling up on the right side of the head portion 40A of the greeting card 200 also reveals a die cut piece 49, which in one embodiment is in the shape of a tongue or teeth. When the top or head portion 40A of the greeting card 200 snaps back to its original position, the die cut piece 49 is again concealed within the lower or body portion 40B of the greeting card 200. Lifting the head portion 40A away from the body portion 40B mimics an animal or character opening its mouth, thereby revealing its tongue and or teeth 49.

In a third embodiment of the present disclosure and related inventions, shown in FIGS. 8 through 11, a greeting card 300 is similar to the greeting card 200 of the second embodiment (shown in FIGS. 12 through 15), having two separate and distinct foam portions 60A, 60B which are attached at a hinge or pivot point PP, wherein moving one of the two portions 60A, 60B about the hinge or pivot point PP initiates playback of at least one audio file. This embodiment also includes the release or appearance of a die cut shape 62 from within the greeting card body 60 which contains a message or text sentiment (or other printing) thereon. As described above with respect to the second embodiment, the greeting card 300 contains two separate and distinct foam pieces, an upper portion (also referred to herein as "top portion" or "upper body") 60A which represents the upper body of an animal or character, and a lower portion (also referred to herein a "bottom portion" or "lower body") 60B which represents the lower body of an animal or character. As mentioned above with respect to the second embodiment, this greeting card 300 may also be made of foam F, although other materials have been considered, such as plastic, paper, paperboard, cardboard, etc. Also, mentioned above with respect to the second embodiment, each of the upper 60A and lower 60B portions of this greeting card 300 may contain a planar sheet material 63 attached to the front and rear surfaces thereof. The planar sheet material 63 is preferably die cut into the shape of the first (head) 60A and second (body) 60B foam pieces with printing thereon to further represent the head and body of an animal or character. The first foam piece or head 60A of the animal or character may be a solid foam piece F which is covered on a front surface with a planar sheet material 63 which is the front or side view of the head and face of an animal or character. The second foam piece or body 60B of the animal or character may be a foam piece F having one or more cavities therein for the storage of the internal components of the greeting card 200 or may be a frame-like structure surrounding said internal components. As noted above, the planar sheet material 63 can contain printing thereon such as text sentiment, pictures, photos, drawings, etc. In one embodiment, as with the first embodiment, the planar sheet material 63 attached to the front surface of both the upper 60A and lower 60B body portions depicts a front or side view of an animal or character. A sentiment panel 64, which is an additional planar sheet may be attached to the planar sheet material 63 attached to the rear surface of the greeting card body 60 (preferably to the larger piece). The sentiment panel 64 folds away from the rear planar sheet material 63 to mimic a traditional greeting card. The inside or front surface of the sentiment panel 64 may contain text sentiment and other printing thereon and may include space for the sender to include written sentiment and a signature. The upper 60A and lower 60B body portions of the greeting card 300 are attached via a hinge mechanism that allows the upper body 60A to tilt or pivot about a hinge or pivot point with respect to the lower body 60B. A die cut shape 62 is also attached to the hinge mechanism such that when the upper body 60A is hinged or pivoted with respect to the lower body 60B, the die cut shape 62 emerges from within the greeting card body 60. The die cut shape 62, which resembles a thought or word bubble, moves from a first position wherein it is concealed within the greeting card body 60 and a second position wherein it is substantially outside of the greeting card body 60. The hinge mechanism of this embodiment is configured such that the upper body portion 60A of the greeting card 300 hinges forward or towards the lower body portion 60B of the greeting card 300. The movement mimics the animal or character bending over in a forward fold. The hinge mechanism of this embodiment contains a single lever 65 that, at one end, is statically attached to the upper body portion 60A of the greeting card 300 and at the opposite end, is attached or inserted into a curved slot 66 contained on the die cut shape 62. The single lever 65 of the hinge mechanism also hingedly connects the upper 60A and lower 60B body portions of the greeting card 300 about a pivot point PP. The greeting card 300 moves from a first position, shown in FIGS. 8 and 10, wherein the upper body portion 60A of the greeting card 300 is directly atop the lower body portion 60B of the greeting card 300 and the die cut shape 62 is contained and concealed within the greeting card body 60, to a second position, shown in FIGS. 9 and 11, wherein the upper body portion 60A of the greeting card 300 is hinged or bent forward (to the right) toward the lower body portion 60B of the greeting card 300 and the die cut shape 62 is substantially outside of the greeting card body 60. An electronics or sound module contained within the greeting card 300 is the same as the sound module described above with respect to the second embodiment. Movement of the upper body portion 60A of the greeting card 300 causes a lever L from the switch mechanism to press against a portion of the lower body portion 60B of the greeting card 300 thereby moving the lever L and causing completion of the electrical circuit and playback of the audio file. Unlike the first embodiment, this embodiment contains no spring-loaded element so the upper body portion 60A of the greeting card 300 does not snap back to its original positon upon hinging or pivoting it with respect to the lower body portion 60B. When the upper body 60A is hinged or pivoted toward the lower body portion 60B it remains in that position until it is physically moved back to the original position. In operation, the greeting card recipient may open the greeting card 300 by moving the sentiment panel 64 away from the greeting card body 60 to view the text sentiment or other printing thereon and to view the optional personalized message and signature written by the greeting card sender. The front face of the greeting card 300 may contain printing or a sticker thereon which instructs the greeting card recipient to "pull down" on the top portion 60A of the greeting card 300. Pulling downward on the head portion 60A of the greeting card 300 causes it to pivot or hinge about the pivot point PP which causes the lever L to move from its original position, completing the electrical circuit and triggering playback of the at least one audio file from the sound module. The hinging movement also causes a die cut shape 62 to emerge from the greeting card body 60. The die cut shape 62 is in the form of an idea or word bubble and may contain text sentiment or other printing thereon. Once a user pulls down on the head portion 60A of the greeting card 300 the die cut shape emerges and the card stays in the hinged position with the die cut shape 62 outside of the greeting card body 60. To initiate another audio clip, the user must first physically move the head portion 60A of the greeting card 300 back to its original position atop the body portion 60B of the greeting card 300 (also causing the die cut shape 62 to re-enter the greeting card body 60) and then re-pull the head portion 60A downward toward the body portion 60B.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. The gift card and greeting card embodiments of the present disclosure and related inventions have been described with respect to particular embodiments as shown in the figures. However, alterations and substitutions may be made to these embodiments while remaining within the scope of this invention. For example, the number of parts of the gift card holder and greeting cards has been described herein and shown in the figures as being two, however, other numbers of parts may be used. The shape of the gift card holder and greeting cards and the materials of which they are made can be changed to other shapes and materials. Also, the direction and type of movement of the pieces of the gift card holder and greeting cards may be changed. The number and type of parts in the hinge mechanism may be altered to include more or fewer parts and the types of parts may be different as well. The number of levers and pivot points in the hinge mechanism may also be varied to include less or more levers and/or pivot points. While the position of the various electronic and mechanical components is specified and shown in the figures as being in a specific location, the various components of the gift card holder and greeting cards may be in different locations or positions while still remaining within the scope of the invention. The switches have been described herein and shown in the figures as being a particular kind of switch, although other switches have been contemplated, such as a slide switch, a magnetic switch, a light sensitive switch, a touch sensitive switch, and a motion sensitive switch and are considered to fall within the scope of the invention. It is intended that the invention be defined by the following claims.

The invention claimed is:

1. A greeting card comprising:

a greeting card body comprising an upper portion and a lower portion, the upper and lower portions being connected at a pivot point;

a sound module contained within the greeting card body which is operative to store and playback at least one audio cup;

a planar die cut shape which moves from a first position wherein it is contained inside the greeting card body and a second position wherein it is substantially outside of the greeting card body;

wherein partially pivoting the upper portion of the greeting card body away from or towards the lower portion of the greeting card body triggers the sound module to play the at least one audio clip and causes the planar die cut shape to move from the first to second position; and wherein the upper portion of the greeting card body springs back to its original position after partially pivoting the upper portion of the greeting card body away from the lower portion of the greeting card body.

2. The greeting card of claim 1, wherein the planar die cut shape is a word bubble with text printed thereon.

3. The greeting card of claim 1, wherein the upper and lower portions of the greeting card body are separate and distinct from each other.

4. The greeting card of claim 1, wherein the sound module contains a plurality of different audio clips.

5. A greeting card comprising:

a greeting card body having a first portion and a second portion;

a sound module contained within the greeting card body; the sound module operative to store and playback at least one audio file;

a planar die cut shape contained within the first or second portion of the greeting card body;

wherein moving the first portion of the greeting card toward or away from the second portion causes the sound module to playback the at least one audio file and causes the planar die cut shape to move from a first position where it is concealed inside at least one of the first portion and second portion and a second position wherein it is substantially outside the at least one of the first portion and second portion.

6. The greeting card of claim 5, wherein the first and second portions of the greeting card body are connected at a pivot point.

7. The greeting card of claim 5, wherein the first portion of the greeting card body can only partially pivot about the second portion of the greeting card body.

8. The greeting card of claim 5, wherein the first portion of the greeting card body sits above the second portion of the greeting card body.

9. A greeting card comprising:

a greeting card body having a first portion and a second portion, the first and second portions of the greeting card body being attached at at least one point;

a sound module contained within the greeting card body, the sound module operative to store and playback at least one audio clip;

wherein moving the first portion of the greeting card body toward or away from the second portion causes the sound module to play the at least one audio clip through a speaker and also causes at least one planar die cut shape to move from a first position wherein it is concealed within at least one of the first portion and second portion and a second position wherein it is at least substantially outside of the at least one of the first portion and second portion.

* * * * *